US008894353B2

(12) United States Patent
McCracken et al.

(10) Patent No.: US 8,894,353 B2
(45) Date of Patent: Nov. 25, 2014

(54) TURBINE BLADE SYSTEM

(75) Inventors: James McCracken, York, SC (US); Christoph Hermann Richter, Ibbenbüren (DE)

(73) Assignee: Siemens Aktiengesellschaft, Munich (DE)

( * ) Notice: Subject to any disclaimer, the term of this patent is extended or adjusted under 35 U.S.C. 154(b) by 592 days.

(21) Appl. No.: 13/146,964

(22) PCT Filed: Jan. 12, 2010

(86) PCT No.: PCT/EP2010/050271
§ 371 (c)(1),
(2), (4) Date: Oct. 14, 2011

(87) PCT Pub. No.: WO2010/086214
PCT Pub. Date: Aug. 5, 2010

(65) Prior Publication Data

US 2012/0020793 A1 Jan. 26, 2012

(30) Foreign Application Priority Data

Jan. 29, 2009 (EP) ..... 09001257

(51) Int. Cl.
*F01D 5/22* (2006.01)
*F01D 5/26* (2006.01)

(52) U.S. Cl.
CPC *F01D 5/22* (2013.01); *F01D 5/225* (2013.01); *F05D 2250/314* (2013.01); *F05D 2250/231* (2013.01); *F05D 2260/96* (2013.01); *F05D 2220/31* (2013.01); *Y10S 416/50* (2013.01)
USPC ..... 415/119; 416/190; 416/193 R; 416/500

(58) Field of Classification Search
CPC ..... F01D 5/22; F01D 5/225; F01D 5/26; F01D 25/06; F05D 2260/96; F05B 2260/964
USPC ..... 415/190, 191, 192, 500, 119; 416/190, 416/191, 192, 500, 193 R
See application file for complete search history.

(56) References Cited

U.S. PATENT DOCUMENTS 1,061,648 A * 5/1913 Westinghouse ..... 416/191
1,544,318 A * 6/1925 Hodgkinson ..... 416/193 R
(Continued)

FOREIGN PATENT DOCUMENTS

CN 88101214 A 9/1988
CN 1534166 A 10/2004
(Continued)

OTHER PUBLICATIONS

JP2005-256786A English Machine Translation.*
(Continued)

*Primary Examiner* — Edward Look
*Assistant Examiner* — Wayne A Lambert

(57) ABSTRACT

A turbine blade system including a first turbine blade and a second turbine blade being arranged adjacent to each other shall be suited to allow a particularly secure and reliable operation of a turbine. To this end, the turbine blades are in contact in a first surface area and separated from each other in a second surface area, wherein the first turbine blade includes a pocket containing a damping piece in the second surface area.

15 Claims, 1 Drawing Sheet

(56) References Cited

U.S. PATENT DOCUMENTS

| | | | | | |
|---|---|---|---|---|---|
| 2,430,140 | A | * | 11/1947 | Phelan et al. | 416/217 |
| 2,454,115 | A | * | 11/1948 | Allen | 416/196 R |
| 2,772,854 | A | * | 12/1956 | Anxionnaz | 416/190 |
| 3,795,462 | A | * | 3/1974 | Trumpler, Jr. | 416/196 R |
| 3,837,761 | A | * | 9/1974 | Brown | 416/191 |
| 3,986,792 | A | * | 10/1976 | Warner | 416/190 |
| 4,155,152 | A | * | 5/1979 | Cretella et al. | 29/889.1 |
| 4,257,743 | A | * | 3/1981 | Fujii | 416/196 R |
| 4,386,887 | A | * | 6/1983 | Ortolano | 416/190 |
| 4,568,247 | A | * | 2/1986 | Jones et al. | 416/190 |
| 4,776,764 | A | * | 10/1988 | Ortolano | 416/196 R |
| 4,840,539 | A | | 6/1989 | Bourcier | |
| 5,154,581 | A | * | 10/1992 | Borufka et al. | 416/190 |
| 5,238,366 | A | * | 8/1993 | Ferleger | 416/61 |
| 5,829,955 | A | * | 11/1998 | Saito et al. | 416/191 |
| 6,341,941 | B1 | * | 1/2002 | Namura et al. | 416/190 |
| 2004/0191068 | A1 | * | 9/2004 | Richter et al. | 416/223 R |
| 2005/0111983 | A1 | * | 5/2005 | Goetzfried et al. | 416/191 |
| 2008/0175712 | A1 | * | 7/2008 | Asai et al. | 416/179 |

FOREIGN PATENT DOCUMENTS

| | | | |
|---|---|---|---|
| CN | 101158291 | A | 4/2008 |
| EP | 0537922 | A1 | 4/1993 |
| EP | 1944466 | A1 | 7/2008 |
| GB | 2226368 | A | 6/1990 |
| JP | 63246402 | A | 10/1988 |
| JP | 7091206 | A | 4/1995 |
| JP | 2000204901 | A | 7/2000 |
| JP | 2005256786 | A | 9/2005 |
| WO | WO 03014529 | A1 | 2/2003 |

OTHER PUBLICATIONS

WO03 014529 English Machine Translation.*

Tomii, JP2005-256786A English Machine Translation, Translated by Espacenet Jan. 7, 2014.*

Machida, WO03 014529 English Machine Translation, Translated by Patentscope Jan. 8, 2014.*

* cited by examiner

TURBINE BLADE SYSTEM

CROSS REFERENCE TO RELATED APPLICATIONS

This application is the U.S. National Stage of International Application No. PCT/EP2010/050271, filed Jan. 12, 2010 and claims the benefit thereof. The International Application claims the benefits of European Patent Office application No. 09001257.6 EP filed Jan. 29, 2009. All of the applications are incorporated by reference herein in their entirety.

FIELD OF INVENTION

The invention is related to a turbine blade system comprising a first turbine blade and a second turbine blade being arranged adjacent to each other. It is further related to a steam turbine and a gas turbine.

BACKGROUND OF INVENTION

A turbine is a rotary engine that extracts energy from a fluid flow. The simplest turbines have one moving part, a rotor assembly, which is a shaft with a number of blades attached along its circumference. Moving fluid acts on the blades, or the blades react to the flow, so that they rotate and impart energy to the rotor.

Power plants usually use steam or gas turbines connected to a generator for electrical power generation. A gas turbine usually has an upstream compressor coupled to a downstream turbine, and a combustion chamber in-between. Energy is added to the gas stream in the combustor, where compressed air is mixed with fuel and ignited. Combustion increases temperature, velocity and volume of the gas flow, which is subsequently directed over the turbine's blades spinning the turbine and powering the combustor and any connected device.

Steam turbines use pressurized steam from e.g. a steam generator as its working fluid. To increase thermal efficiency, the steam can be expanded in multiple turbine stages. Here, steam flow exits from a high pressure section of the turbine and is returned to the boiler where additional superheat is added. The steam then goes back into an intermediate pressure section of the turbine and continues its expansion.

Especially in low pressure sections of turbines, large back-end blades are susceptible to vibratory excitation. In order to limit the amplitudes occurring in various situations and to prevent damage due to strong vibration, vibrational dampers are used in some designs. This can be achieved by e.g. solid body frictional damping between turbine blades, which limits said vibrations. However, allowing friction to damp vibration requires relatively loose contact of adjacent turbine blades, reducing the stability of the turbine blade system.

SUMMARY OF INVENTION

The problem of the present invention is therefore to provide a turbine blade system of the abovementioned kind which is suited to allow a particularly secure and reliable operation of a turbine.

This problem is solved according to the invention by adjacent turbine blades each having shrouding bands being in contact in a first surface area of the shrouding band and being separated from each other in a second surface area of the shrouding band, wherein the first turbine blade comprises a pocket containing a damping piece in the second surface area of the shrouding band.

The invention is based on the consideration that a particularly secure and reliable operation of a turbine could be achieved if a stable and stiff assembly of a turbine blade system could be created which at the same time allows dampening of vibrational excitations through solid body friction. However, solutions which utilise design features to couple all of the blades in a row such as contact between adjacent blades at the tip, mid height or both serve two opposing purposes: the stiffening of the assembly and the ability to dissipate vibratory energy by friction in the contact interface. The stiffening requires proper engagement of the surfaces with big pressing forces to ensure that no wobbling or macro-sliding can occur. The ability to damp vibrations requires relatively loose contact with relatively low pressing force, which can in turn lead to uncontrolled natural frequencies in the blade assembly.

To fulfill both of these two opposing sub-functions, it is suggested to separate both functions into different areas of the surface of the blades, i.e. a first surface area being in close, properly engaged contact that secures stiffening of the assembly, and a second surface area in loose contact that allows vibration damping through friction. To achieve this, the turbine blades are separated from each other in the second surface area and the first turbine blade comprises a pocket containing a damping piece that is properly arranged to allow friction, yielding mechanical damping.

In an advantageous embodiment, the first surface area is inclined in relation to the second surface area. Then, the pressing forces for each of the surface areas are not parallel to each other and can therefore be easily adjusted independently. This allows a particularly exact adjustment of the pressing forces for each surface area and facilitates the separation of stabilization and vibration damping.

To allow movement of the damping piece towards the adjacent turbine blade, the damping piece advantageously has a cylindric shape. The cross-section of the cylinder can be any geometric shape, e.g. a circle for easy manufacturing of the piece, or any polygon for proper fitting of the damping piece into the pocket and its stabilization. A cylindric shape allows movement of the damping piece in and out of the surface. Vibration of the blade assembly will lead to relative motion between the damping piece and the adjacent blade and due to the movability of the damping piece in the pocket also between the damping piece and the pocket wall, allowing a particularly good dissipation of vibrational energy through friction.

In a further advantageous embodiment, the axis of the cylindric shape is inclined in relation to the perpendicular of the surface in the area of the pocket. With properly chosen inclination angle and direction with respect to the rotor movement, the inclination allows the damping piece to slide radially outwards of the pocket under the action of centrifugal force. Due to that it contacts the adjacent turbine blade, forming a friction surface to dampen vibrations, with the centrifugal force acting as the pressing force. The strength of pressing force can then be easily adjusted by choice of the inclination angle. Also, vibrational excitations are damped by friction due to relative movement of the damping piece and the leading edge as well as the damping piece and the pocket walls.

To increase friction of the damping piece with the pocket walls, the inner shape of the pocket advantageously fits the outer shape of the damping piece. This also provides proper hold of the damping piece in directions parallel to the surface area while at the same time—in case of a cylindrical damping piece—allowing movement in the direction of the cylinder axis.

To further improve the hold and stabilization of the damping piece inside the pocket and prevent the damping piece from slipping out of the pocket, the size of the damping piece in perpendicular direction of the surface in the area of the pocket is advantageously larger than the separation of the turbine blades in said area.

In a particularly advantageous embodiment, each adjacent pair of turbine blades of a blade row of the turbine blade, is arranged as described above, i.e. is in contact in a first surface area and separated from each other in a second surface area, and wherein one turbine blade comprises a pocket containing a damping piece in said second surface area. This leads to a particularly good vibrational damping and stability of the whole blade row in a turbine.

Advantageously, a turbine blade system of the above kind is part of a steam turbine and or a gas turbine. The combination of stabilization and vibrational damping in the turbine blade system allows a particularly secure and reliable operation of a turbine.

Furthermore, a combined cycle power plant advantageously comprises a steam turbine and/or a gas turbine with said turbine blade system.

The advantages achieved by the present invention particularly comprise that by arranging two turbine blades of a turbine blade system such that they are in contact in a first surface area and separated from each other in a second surface area, wherein the first turbine blade comprises a pocket containing a damping piece in the second surface area, both stabilization and vibrational damping can be accomplished, leading to a particularly secure and reliable operation of a turbine. A proper inclination of the pocket allows the damping piece slide against the adjacent turbine blade under the action of centrifugal force, yielding mechanical damping through friction between the damping piece and the adjacent blade and pocket walls. Here, the material of the piece can be chosen such that fretting and wear is prevented. The required stiffening is provided by the first surface area in contact with the adjacent blade. Furthermore, the damping piece feature can be used for a variety of turbine blade designs such as interlocked and free-standing blades.

BRIEF DESCRIPTION OF THE DRAWINGS

An embodiment of the present invention is illustrated in detail in the following figure.

All parts have the same reference signs in both FIGs.

DETAILED DESCRIPTION OF INVENTION

Figure 1:
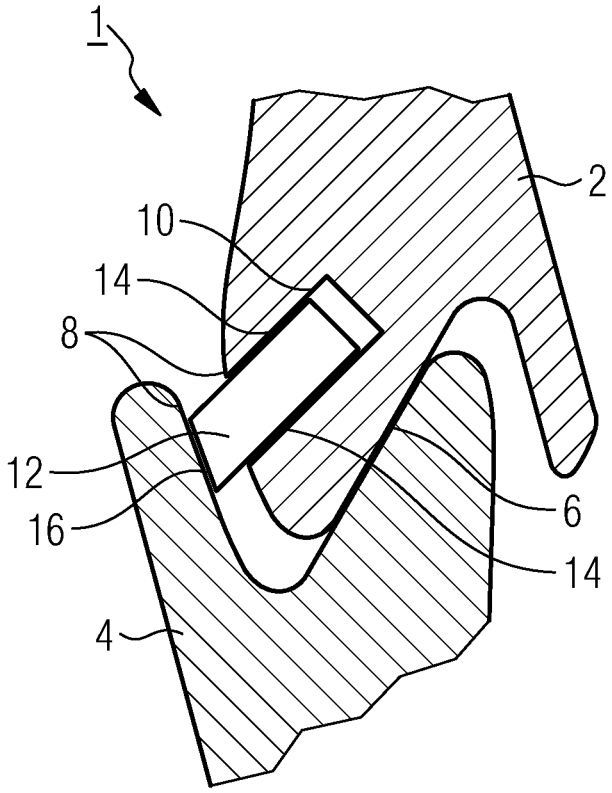
FIG. 1 shows a turbine blade system in a radial view.

The turbine blade system 1 according to FIG. 1 comprises a first turbine blade 2 and a second turbine blade 4 that are arranged next to each other. FIG. 1 shows a cross-section of the turbine blades 2, 4, viewed in radial direction towards the turbine axis. The FIG. 1 shows a shrouding band of the first turbine blade 2 and the second turbine blade 4.

To ensure stability of the turbine blade system 1 during operation of the turbine, the shrouding bands of turbine blades 2, 4 are arranged in close contact in a first surface area 6. Here, a relatively big pressing force is impinged on the surface area 6 which ensures proper engagement of the turbine blades 2, 4 and stiffening of the turbine blade system 1 to avoid wobbling and sliding during turbine operation.

The close contact of the turbine blades 2, 4 in the first surface area 6 yields the danger of uncontrolled vibrational excitation of the turbine blade system 1. To avoid this, the turbine blades 2, 4 are separated from each other in a second surface area 8 and the first turbine blade comprises a pocket 10 which contains a damping piece 12. The damping piece 12 has a cylindrical shape fitting the walls 14 of the pocket 10, so that the damping piece 12 is movable inside the pocket 10. However, the length of the damping piece 12 is chosen to be long enough to ensure a proper hold of the damping piece 12 in the pocket 10. The material of the damping piece 12 is chosen such that fretting and wear is prevented.

The damping piece 12 is in contact with the second turbine blade 4, however due to the movable design of the damping piece 12, the contact is relatively loose. Vibrational excitations of the turbine blade system 1 will lead to relative motion of the damping piece 12 and the second turbine blade 4 at their contact surface 16 as well as the damping piece 12 and the pocket walls 14. The resulting friction leads to dissipation of the vibrational energy and consequently to a damping of the vibration.

The surface areas 6, 8 are inclined with respect to each other, such that a force perpendicular to the surface area 6 is not necessarily implying the same force on the surface area 8. Therefore the pressing forces for both surface areas 6, 8 can be chosen independently.

Figure 2:
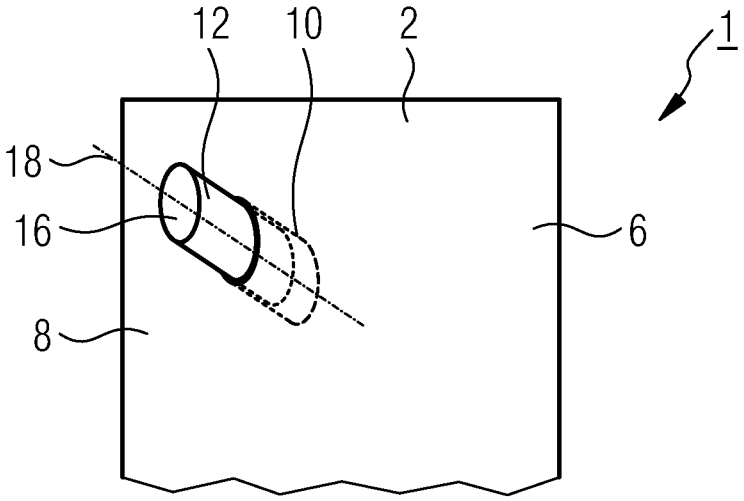
FIG. 2 shows the turbine blade system in a circumtangential view.

FIG. 2 shows a circumtangential view of the first turbine blade 2, showing the surface areas 6, 8, the pocket 10 and the cylindrical damping piece 12. The axis 18 of the cylindrical damping piece 12 is inclined with respect to the perpendicular of the surface of the turbine blade 2 in the area of the pocket 10. Thus, when the turbine is in motion, the damping piece slides out of the pocket 10 under the action of centrifugal force. The centrifugal force presses the damping piece 10 against the second turbine blade 4. The angle of the inclination can be chosen such that the desired force is acting on the contact surface 16.

In a turbine blade system 1 as shown above, the functions of stabilization and vibrational damping are separated on different surface areas 6, 8. This leads to a better stiffening of the turbine blade system 1 while at the same time allowing vibrational damping through solid-body friction, allowing a safer and more reliable operation of a turbine.

The invention claimed is:

1. A turbine blade system, comprising:

a first turbine blade; and a second turbine blade, wherein each turbine blade has a shrouding band arranged adjacent to each other, in contact in a first surface area and separated from each other in a second surface area of the shrouding bands, wherein the first turbine blade comprises a pocket having a damping piece in the second surface area, wherein the damping piece includes a cylindrical shape fitting cylindrical-shaped walls of the pocket so that the damping piece is moveable inside the pocket along an axis of the cylindrical shape, and wherein an axis of the cylindrical shape is inclined in relation to a perpendicular of a surface in an area of the pocket.

2. The turbine blade system according to claim 1, wherein the first surface area is inclined in relation to the second surface area.

3. The turbine blade system according to claim 1, wherein an inner shape of the pocket fits an outer shape of the damping piece.

4. The turbine blade system according to claim 1, wherein a size of the damping piece in a perpendicular direction of the surface in the area of the pocket is larger than the separation of the first turbine blade and the second turbine blade in the area.

5. The turbine blade system according to claim 1, wherein each adjacent pair of turbine blades of a blade row is in contact in a first surface area and separated from each other in a second surface area, and wherein one turbine blade of the adjacent pair comprises one pocket containing a damping piece in the second surface area.

6. A steam turbine, comprising:

a turbine blade system according to claim 1.

7. The steam turbine according to claim 6, wherein the first surface area is inclined in relation to the second surface area.

8. The steam turbine according to claim 6, wherein an inner shape of the pocket fits an outer shape of the damping piece.

9. The steam turbine according to claim 6, wherein a size of the damping piece in a perpendicular direction of the surface in the area of the pocket is larger than the separation of the first turbine blade and the second turbine blade in the area.

10. The steam turbine according to claim 6, wherein each adjacent pair of turbine blades of a blade row is in contact in a first surface area and separated from each other in a second surface area, and wherein one turbine blade of the adjacent pair comprises one pocket containing a damping piece in the second surface area.

11. A gas turbine, comprising:

a turbine blade system according to claim 1.

12. The gas turbine according to claim 11, wherein the first surface area is inclined in relation to the second surface area.

13. The gas turbine according to claim 11, wherein an inner shape of the pocket fits an outer shape of the damping piece.

14. The gas turbine according to claim 11, wherein a size of the damping piece in a perpendicular direction of the surface in the area of the pocket is larger than the separation of the first turbine blade and the second turbine blade in the area.

15. The gas turbine according to claim 11, wherein each adjacent pair of turbine blades of a blade row is in contact in a first surface area and separated from each other in a second surface area, and wherein one turbine blade of the adjacent pair comprises one pocket containing a damping piece in the second surface area.

* * * * *